United States Patent [19]

Shirey et al.

[11] Patent Number: 4,678,027

[45] Date of Patent: Jul. 7, 1987

[54] DUAL-WALLED COILED PLATE HEAT EXCHANGER WITH VENTED INTERFACE

[75] Inventors: Phillip G. Shirey, Nixa; David W. Rowe, Springfield; William R. Waynick, Walnut Grove, all of

[73] Assignee: Paul Mueller Company, Springfield, Mo.

[21] Appl. No.: 681,873

[22] Filed: Dec. 14, 1984

[51] Int. Cl.[4] ..... F28F 11/00

[52] U.S. Cl. ..... 165/70; 165/170

[58] Field of Search ..... 165/70, 164, 170

[56] References Cited

U.S. PATENT DOCUMENTS

| | | | |
|---|---|---|---|
| 2,979,310 | 4/1961 | Nicholson | 165/164 X |
| 4,146,089 | 3/1979 | Mueller et al. | 165/145 |
| 4,179,902 | 12/1979 | Mueller et al. | 165/184 |
| 4,249,597 | 2/1981 | Carey | 165/70 X |
| 4,305,456 | 12/1981 | Mueller et al. | 165/145 |
| 4,484,623 | 11/1984 | Rowe et al. | 165/164 |
| 4,529,033 | 7/1985 | Blum | 165/70 X |

FOREIGN PATENT DOCUMENTS

| | | | |
|---|---|---|---|
| 1019319 | 7/1976 | Canada | 165/70 |

*Primary Examiner*—Albert W. Davis, Jr.
*Assistant Examiner*—Peggy Neils
*Attorney, Agent, or Firm*—Rogers, Howell, Moore & Haferkamp

[57] ABSTRACT

A dual-walled coiled plate heat exchanger with vented interface includes four plates of stainless steeel welded together and inflated to form a refrigerant passage between two of the plates, a water passage between another two of the plates, and a vented interface between the two passages such that leakage from either of the passages into the interface is vented to the atmosphere and not to the other passage.

13 Claims, 9 Drawing Figures

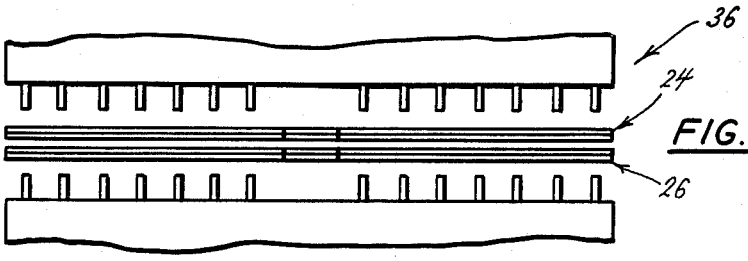
FIG. 4.
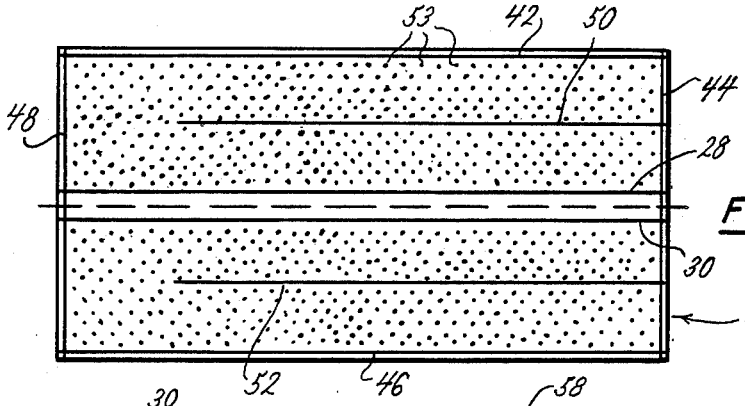
FIG. 5.
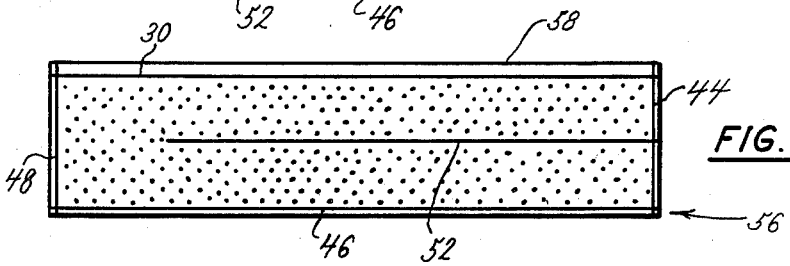
FIG. 6.
FIG. 7.
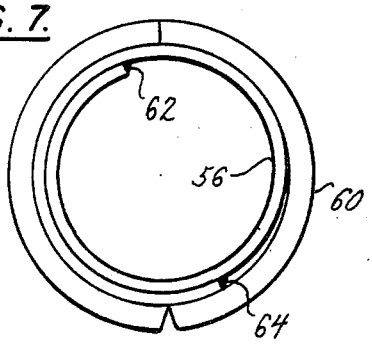
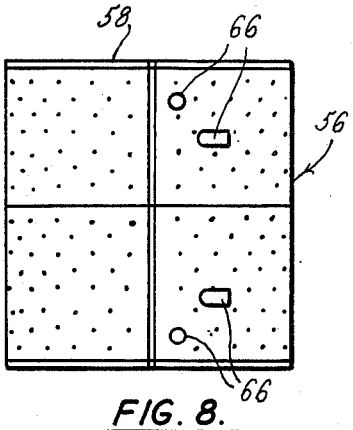
FIG. 8.
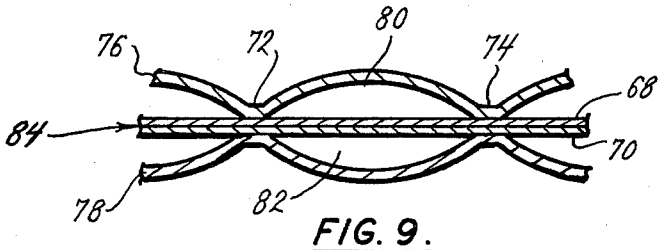
FIG. 9.

DUAL-WALLED COILED PLATE HEAT EXCHANGER WITH VENTED INTERFACE

BACKGROUND AND SUMMARY OF THE INVENTION

Coiled plate type heat exhangers are well known in the art, and the assignee of the present invention is the assignee of several patents which disclose invention designs of coiled plate heat exchangers utilized in condensors designed to recover the waste heat from refrigeration systems to heat water for diary farms and the like. Examples of these are U.S. Pat. Nos. 4,146,089, 4,179,902 and 4,305,456. As disclosed in these prior patents, a coiled plate heat exchanger may be constructed by seam welding a pair of plates along their edges, resistance welding a plurality of spot welds across the face of the plate, and inflating the plate under pressure to expand the sides away from each other and create a "pillowing" effect to dramatically increase the size of the passageway between the plates. The plate may be coiled into an annular configuration before it is inflated, and once inflated fixed in that annular configuration to reduce the size of the heat exchanger. This plate heat exchanger design has been quite successful, and is well received in the industry.

As shown in these prior patents, the coiled plate may then be placed in a container, refrigerant pumped through the plate, and water permitted to convection flow through the container as it is heated by the refrigerant, the refrigerant being cooled by the water and condensed for reuse by the refrigeration system.

In some other applications, the assignee has also manufactured and sold a variation of this coiled plate type heat exchanger which utilizes a center or middle plate, with two outer plates surrounding the middle plate to thereby create a passageway between each of the outer plates and the middle plate. This dual flow condensor is described in U.S. Pat. No. 4,484,623 also owned by the assignee of the present invention. As disclosed therein, this sandwich plate type heat exchanger may be coiled and also used in a condensor unit to heat water as shown in the patents listed above, with the exception that refrigerant may flow through one side of the plate and water may flow through the other side of the plate, there thereby being no need to immerse the entire plate in a container which is water tight.

While both types of construction are more than adequate in providing separation between the refrigerant and the water, safety standards have been established by Underwriters Laboratories Inc. for heat exchangers to be used in referigerant heat recovery systems for heating potable water which require designs which minimize the risk of contamination of the water. One such design which meets the criteria established by UL is a design which provides double wall separation between the potable water and the refrigerant, with a vented interface between the two interior double walls so that if leakage develops in the heat exchanger wall which contains the refrigerant, it will not pressurize the interface or exert pressure on the other interior wall which could, over time, result in failure of the other wall thus allowing refrigerant to leak into the potable water. UL's standards further require that the interface be maintained at near atmospheric pressure, and that the venting path be continuous over the entire length of the heat exchanger. The continuity of the venting path is determined by pressurizing the interface with water at a pressure not higher than 10 psig, and then testing for leaking from the interface within a one minute time limit. The passageway which conducts the refrigerant must be capable of withstanding a hydrostatic pressure equivalent to five times the maximum rated design pressure as the water side is maintained at atmospheric pressure. The passageway for the water must be capable of withstanding a hydrostatic pressure of at least 300 psig, which is the same requirement as UL has established for water heater storage tanks.

These standards are quite difficult to meet as the typical refrigerant system is rated at 400 psig, which requires a test at more than 2,000 psig. In an expanded plate which has been "pillowed", the plate to be pillowed must be sufficiently thin that pillowing can be easily achieved, and yet sufficiently strong to hold its weld at the spot welds. Furthermore, as different alloys of stainless steel are typically utilized in the different plates of an assembly, and their thicknesses are different as explained above, and the spot welder which applies the welds to the plates generates a great deal of heat in performing its welding process which is difficult to dissipate and yet maintain a reasonable speed of manufacture, the stainless steel plates have a tendency to gather or wrinkle as two or more plates are welded together. As can be appreciated, what may be a minor irritation when welding two plates together is somewhat worsened when three plates are attempted in the sandwich plate construction, much less the severe situation created by attempting the spot welding process with four plates.

Despite these many obstacles, the inventors herein have succeeded in developing a method of manufacturing a dual-walled coiled plate type heat exchanger with a vented interface which meets the requirements of UL and has been certified for UL listing. Briefly, the method consists of taking four rectangular sheets of stainless steel, punching the necessary holes in the sheets to accommodate fluid tight connections as taught by U.S. Pat. No. 4,484,623, and taking the four plates two at a time and resistance seam welding a pair of seams the length of each pair along the central portion of each pair which in effect joins each pair individually together. During this welding step, it has been found that placing a roller or other support underneath the plates as they are being welded will deflect the plates and serve to prevent wrinkling or gathering of the plate as the welder heats the plate during the welding process. This is very effective in minimizing wrinkling and permits the welder to move continuously in a reasonable manufacturing speed across the plates, without inordinate stopping of the process to permit cooling or any other means used to cool the plates. Next, the two pairs of plates are aligned and welded with spot welds in a uniform pattern across the surface of the plates. These spot welds extend through all four plates, and serve to join all four plates together.

After the four plates are joined across their surface by the plurality of spot welds, the seams are welded along the outer periphery of the plate, and baffles are also seam welded into the assembly on both sides of the middle seam welds. At this point, the assembly is sheared between the middle seams which thereby creates a pair of heat exchanger plate assemblies, each assembly having all four plates welded along three of its sides, with the fourth side adjacent the seam weld being vented between the middle plates. Each of the assemblies may then be separately processed by rolling the assembly into an annular configuration, assembling the fluid connections through the holes previously punched, placing the assembly in a fixture, inflating both passages in both sides of the assembly at the same time and under substantially the same pressure, and then welding the assembly into the annular configuration to hold it after removal from its fixture. It is noted that simultaneous inflation of both passages tends to force the middle plates into close thermal contact. It has been found that there still remains sufficient separation to permit the flow of fluid towards the middle seam, and hence vent the interface, as is required to meet the UL standard. To enhance this separation, the inventors have found that the middle plates may be roughened prior to assembly so that the middle plates have a tendency to remain further separated when the passages are inflated.

In one embodiment of the invention, the four plate assembly may be built from 18 gauge and 20 gauge 316L alloy stainless steel on one side, and 18 gauge and 20 gauge 304 alloy stainless steel on the other. Typically, the heavier gauge plates are on the outside as they are subjected to the intense pressures during testing.

The foregoing brief description is merely a synopsis of the invention, the details of which may be more fully understood by referring to the drawings and description of the preferred embodiment which follow.

BRIEF DESCRIPTION OF THE DRAWINGS

FIG. 4 is a diagramatic front view of the spot welder as it welds two pairs of plates already joined by seam welds;

FIG. 5 is a plan view of a four plate sandwich with middle seams, baffles, and edge seams welded therein;

FIG. 6 is a plan veiw of one-half the four plate assembly shown in FIG. 5;

FIG. 7 is a side view of the plate of FIG. 6 helically coiled in annular configuration and fixed within the fixture;

FIG. 8 is a side view of a completed dual-walled heat exchanger; and

FIG. 9 is a partial cross-sectional view of the construction of the dual-walled heat exchanger with vented interface.

DETAILED DESCRIPTION OF THE PREFERRED EMBODIMENT

Figure 1:
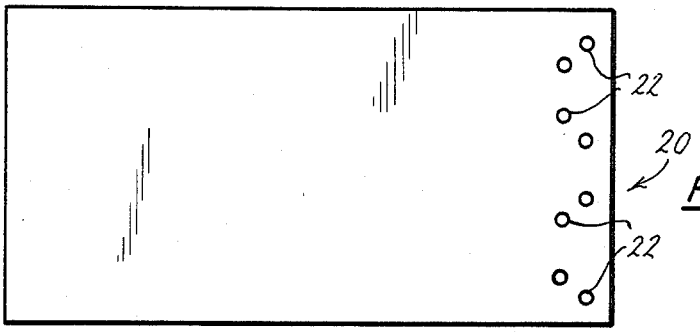
FIG. 1 is a plan view of a single plate with holes punched therein for fluid connection.
Figure 2:
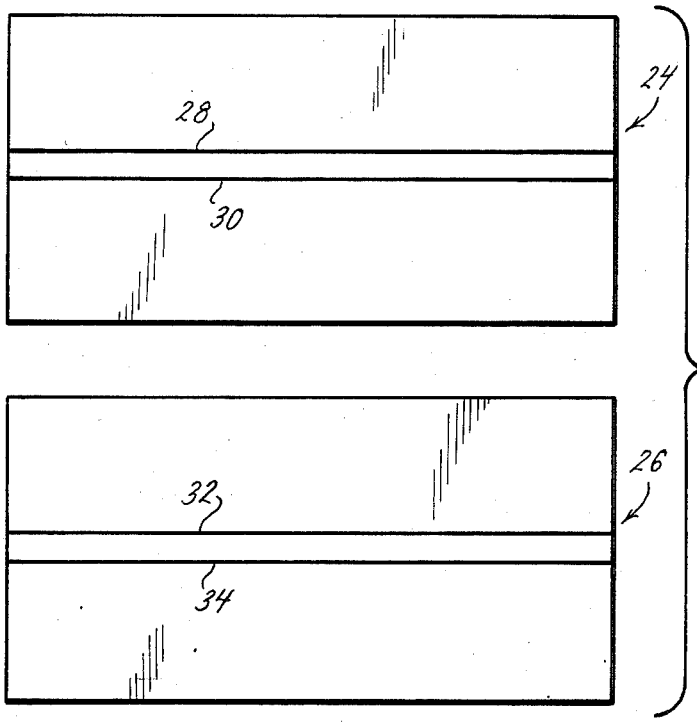
FIG. 2 is a plan view of the two pairs of plates which have seams welded across their length.
Figure 3:
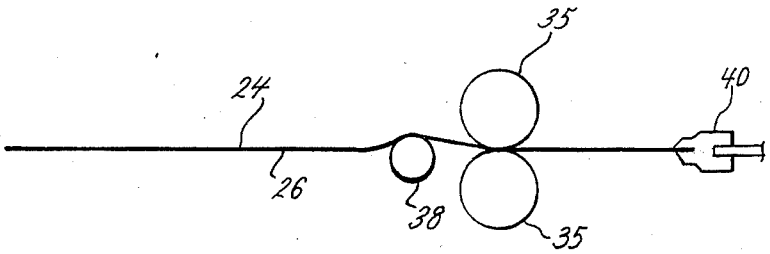
FIG. 3 is a diagramatic side view of the seam welder and roller, with the roller deflecting the plates as they are welded.

To construct the dual-walled vented interface plate coiled heat exchanger of the present invention, four plates such as plate 20 shown in FIG. 1 are cut to approximately the same length and height, and holes 22, as required, are punched or drilled through the plates to prepare them for assembly. The teachings of U.S. Pat. No. 4,484,623, incorporated herein by reference, is instructive in that regard. As mentioned above, typically a heavier guage metal will be used for the outer and inner plates of the assembly. After being appropriately punched, the plates are placed in pairs 24, 26 as shown in FIG. 2 and each pair has two seams 28, 30 and 32, 34 welded along their length and near the middle portion of each pair 24, 26. At this point, each pair 24, 26 has been joined as these seams 28, 30, 32, 34 extend through each of two plates. As shown in FIG. 3, a roller 38 is used to deflect the pairs 24, 26 as the welder 35 is passed across the surface of the plates. A clamp 40 may be used to help position and feed the pairs 24, 26 during this welding process.

Next, the pairs 24, 26 are placed atop each other, and a multi-gun spot welder 36 may be used to weld the pairs 24, 26 together along the surface of the plates at a plurality of spaced locations, much as shown in the prior patents mentioned above. Some adjustment may be made to the spot and row distances between welds to provide optimum support for the plates 20, and the welding machine may be double impulsed to ensure a large weld nugget at each spot. This spot welding process creates spot welds which extend through all four plates of pairs 24, 26.

Referring now to FIG. 5, additional seam welds 42, 44, 46, 48 are made along the periphery of the pairs 24, 26 and two baffle seams 50, 52 are also made in the assembly 54. As can be seen in FIG. 5, spot welds 53 are spaced evenly across the surface of the assembly 54, edge welds 42, 44, 46, and 48 are along the periphery of the assembly 54, and the baffle seams 50, 52 are approximately evenly spaced and extend less than the entire length of the assembly 54, and all of these welds extend through all four plates of assembly 54. Also shown are weld seams 28, 30 which extend only through the top pair 24, and the other pair 26 hidden from view has its own seams 32, 34. As indicated by the dashed line in FIG. 5, the assembly 54 is then sheared between weld seams 28, 30, and weld seams 32, 34 to create the assembly 56 as shown in FIG. 6 which corresponds to the lower half of assembly 54 of FIG. 5. However, as a result of the shear made between weld seams 28, 30, the interface between pairs 24, 26 is vented along the top 58 of assembly 56. This can be understood by remembering that seams 30, 34 of pairs 24, 26 extend only through their respective pairs, and there is no seam weldment which extends through all four plates along this edge. Thus, by this process, two assemblies such as 56 may be formed simultaneously which comprise the dual-walled vented interface heat exchanger of the present invention.

To complete the forming process, assembly 56 may be rolled or coiled in helical fashion. As shown in FIG. 8, fluid connections 66 are then made to the holes 22 punched in the plate 22. The assembly 56 is then placed within fixture 60 and welds 62, 64 are made to secure the coiled assembly 56 in an annular configuration. Assembly 56 may then be inflated to expand the outer and inner plate of the assembly to create a "pillowing" as is best shown in FIG. 9 in cross-sectional view. As shown therein, the two middle plates 68, 70 are virtually flat and adjacent, except that an imperceptible spacing does exist except where spot welds 72, 74 join all four plates 68, 70, 76, 78. Outer plates 76, 78 are substantially "pillowed" away from middle plates 68, 70 to facilitate the circulation of fluid through passageways 80, 82. The vented interface 84 permits close thermal contact between middle plates 68, 70 and yet will leak along upper surface 58 (as shown in FIGS. 6 and 8) should either passage 80, 82 leak.

In operation, should the refrigerant leak from its pressurized passageway into the vented interface, the refrigeration system typically has a pressure drop sensor which will detect the leak and shut the system down. As the refrigerant is vented to the atmosphere, there is no pressure build up which substantially eliminates any possibility that the integrity of the inner wall for the water passageway may be violated. Similarly, if the water passageway leaks to the vented interface, then a pressure drop will be sensed which can be noticed and the system shut down to prevent any cross contamination between the water and refrigeration lines.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

We claim:

1. A coiled plate type heat exchanger, said heat exchanger being comprised of two pairs of plates, means sealing all four plates together along at least a portion, but less than all, of their edges, means sealing each pair separately along the remaining portion of their edges, at least one plate of each pair being at least partially expanded away from its associated plate to thereby form a passageway therebetween for the circulation of a fluid, and means joining the pairs together in close thermal contact, said joining means comprising a plurality of spaced welds, at least some of said welds extending through both pairs of plates, said sealing means thereby forming a vented interface between said pairs, said heat exchanger being coiled into an annular configuration and means to fix said heat exchanger in said annular configuration.

2. The device of claim 1 wherein said spaced welds each comprises a cylindrically shaped resistance spot weld extending through both pairs of plates.

3. The device of claim 1 wherein at least one of the adjacent middle plates has a roughened surface to enhance the flow capability of the vented interface.

4. The device of claim 1 wherein each pair of plates is substantially rectangular in shape, both pairs having approximately the same height and length, both pairs being substantially aligned along their height and length in the heat exchanger, and wherein said remaining portion comprises one complete side of said rectangle.

5. The device of claim 1 wherein one passageway is adapted to conduct potable water, and the other passageway is adapted to conduct refrigerant.

6. The device of claim 1 wherein one passageway has means to withstand inflation at 2050 psi for at least one minute without rupture.

7. The device of claim 1 wherein the vented interface has means to vent fluid injected therein at a pressure of 10 psig continuously along substantially its entire length.

8. The device of claim 1 wherein the plates are made of stainless steel, each of the outer and inner plates of the annular configuration being of thicker guage than the two middle plates.

9. The device of claim 1 wherein the outer and inner plates of the annular configuration are at least partially expanded away from the two middle plates of the annular configuration, the two middle plates being substantially adjacent.

10. The device of claim 10 further comprising a fluid inlet and a fluid outlet connected to each passageway, said fluid inlets and fluid outlets being connected through the outer periphery of the coiled plate heat exchanger.

11. A coiled plate-type heat exchanger, said heat exchanger being comprised of two pairs of plates, means sealing the first pair of plates to each other substantially adjacent their periphery, means sealing the second two plates together substantially adjacent their periphery, means sealing said pairs together along at least a portion, but less than all, of their periphery, at least one plate of each pair being at least partially expanded away from its associated plate to thereby form a passageway therebetween for the circulation of a fluid, one of said pairs being adapted to circulate refrigerant therethrough, the other of said pairs being adapted to circulate potable water therethrough, and means joining the pairs together in close thermal contact, said joining means comprising a plurality of spaced spot welds, at least some of the welds extending through both pairs of plates, said sealing means thereby forming a vented interface between the interior of said pairs, said heat exchanger being coiled into an annular configuration and means to fix said heat exchanger in said annular configuration.

12. The device of claim 11 wherein each plate is substantially rectangular in shape and of the same size, all plates being substantially aligned in the heat exchanger, and wherein said remaining portion of periphery comprises the upper side of said rectangle.

13. The device of claim 11 wherein a single continuous seam weld comprises the sealing means which seals the two pairs together along at least a portion, but less than all, of their periphery.

* * * * *